US008584413B1

(12) United States Patent
Keller, Sr.

(10) Patent No.: US 8,584,413 B1
(45) Date of Patent: Nov. 19, 2013

(54) EASILY CONNECTABLE ANCHOR AND PILLBLOCK REPLACEMENT FOR AN EMBEDDED WOODEN POST

(76) Inventor: William R. Keller, Sr., Ephrata, PA (US)

( * ) Notice: Subject to any disclaimer, the term of this patent is extended or adjusted under 35 U.S.C. 154(b) by 0 days.

(21) Appl. No.: 13/359,543

(22) Filed: Jan. 27, 2012

Related U.S. Application Data

(60) Provisional application No. 61/437,801, filed on Jan. 31, 2011.

(51) Int. Cl.
*E02D 27/32* (2006.01)

(52) U.S. Cl.
USPC ..... 52/297; 52/707; 52/708

(58) Field of Classification Search
USPC ..... 52/296, 297, 298, 704, 707, 708, 711, 52/706, 709, 712, 714, 715, 294, 295, 52/745.15, 745.18
See application file for complete search history.

(56) References Cited

U.S. PATENT DOCUMENTS

| | | | | | |
|---|---|---|---|---|---|
| 284,219 | A | * | 9/1883 | Mehew | 52/154 |
| 705,626 | A | | 7/1902 | Vogel | |
| 880,728 | A | * | 3/1908 | Fuller | 256/52 |
| 953,060 | A | * | 3/1910 | Ross | 52/298 |
| 1,051,301 | A | * | 1/1913 | Wills | 52/704 |
| 1,292,012 | A | | 1/1919 | Morris | |
| 1,321,237 | A | * | 11/1919 | Newman | 52/296 |
| 1,378,948 | A | * | 5/1921 | Hage | 52/298 |
| 2,182,579 | A | * | 12/1939 | Fletcher et al. | 52/370 |
| 2,191,979 | A | * | 2/1940 | Bierbach | 52/370 |
| 2,517,979 | A | * | 8/1950 | Collins | 52/706 |
| 3,342,444 | A | * | 9/1967 | Nelson | 52/165 |
| 3,365,222 | A | * | 1/1968 | Polyak | 403/384 |
| 3,417,525 | A | * | 12/1968 | Dashio | 52/160 |
| 3,727,358 | A | * | 4/1973 | Howell | 52/169.1 |
| 3,892,160 | A | | 7/1975 | Jureit et al. | |
| 4,096,677 | A | | 6/1978 | Gilb | |
| 4,199,908 | A | * | 4/1980 | Teeters | 52/295 |
| 4,283,162 | A | | 8/1981 | Parker, Jr. et al. | |
| 4,296,584 | A | * | 10/1981 | Lempa, Jr. | 52/741.14 |
| 4,387,543 | A | * | 6/1983 | Tschan et al. | 52/295 |
| 4,516,365 | A | * | 5/1985 | Chapman | 52/170 |
| 4,543,757 | A | * | 10/1985 | Cosgrove | 52/295 |
| 4,588,157 | A | * | 5/1986 | Mills | 248/545 |
| 4,614,070 | A | * | 9/1986 | Idland | 52/296 |
| 4,641,474 | A | * | 2/1987 | Cannarsa | 52/514 |
| 4,644,713 | A | * | 2/1987 | Lehman | 52/165 |
| 4,759,161 | A | * | 7/1988 | Kucyk et al. | 52/99 |
| 4,924,648 | A | * | 5/1990 | Gilb et al. | 52/295 |
| 4,995,206 | A | * | 2/1991 | Colonias et al. | 522/97 |

(Continued)

*Primary Examiner* — William Gilbert
*Assistant Examiner* — Gisele Ford
(74) *Attorney, Agent, or Firm* — Andrew D. Mead

(57) ABSTRACT

An anchor device having a plurality of teeth protruding from planar surfaces configured for placement adjacent to the post. The teeth may be forced into the wood to secure the anchor in position until the post embedment is completed. The anchor comprises a first portion that protrudes from the surface of the post to engage with backfill, typically concrete, to resist post uplift once the backfill cures. A second portion of the anchor is secured to the side surfaces of the post adjacent to the end of the post that is to be embedded and extends beyond the end of the post. When the anchor is installed and the post inserted into a hole, the second portion of the anchor elevates the end of the post from the bottom of the post hole so that concrete backfill may flow beneath the post to form a suitable post foundation.

10 Claims, 4 Drawing Sheets

(56) References Cited

U.S. PATENT DOCUMENTS

| | | | | | |
|---|---|---|---|---|---|
| 5,090,656 | A * | 2/1992 | Brown | 248/545 |
| 5,143,472 | A * | 9/1992 | Reed et al. | 403/230 |
| 5,307,603 | A * | 5/1994 | Chiodo | 52/698 |
| 5,333,435 | A * | 8/1994 | Leek | 52/704 |
| 5,375,384 | A * | 12/1994 | Wolfson | 52/295 |
| 5,396,743 | A * | 3/1995 | Bellette | 52/154 |
| 5,456,441 | A * | 10/1995 | Callies | 248/521 |
| 5,467,569 | A * | 11/1995 | Chiodo | 52/713 |
| 5,535,555 | A * | 7/1996 | Boyd et al. | 52/99 |
| 5,568,909 | A * | 10/1996 | Timko | 248/519 |
| 5,575,130 | A * | 11/1996 | Chiodo | 52/713 |
| 5,632,464 | A * | 5/1997 | Aberle | 248/530 |
| 5,666,774 | A * | 9/1997 | Commins | 52/298 |
| 5,848,502 | A * | 12/1998 | Schaefer | 52/165 |
| 6,073,416 | A * | 6/2000 | Peter | 52/835 |
| 6,336,620 | B1 * | 1/2002 | Belli | 248/519 |
| 6,343,446 | B1 | 2/2002 | Beard | |
| 6,461,084 | B1 * | 10/2002 | Stuart | 405/244 |
| 6,513,290 | B2 * | 2/2003 | Leek | 52/295 |
| 6,640,517 | B2 * | 11/2003 | Mitchell | 52/298 |
| 7,296,386 | B2 * | 11/2007 | Leek | 52/296 |
| 7,334,370 | B2 * | 2/2008 | Fordyce et al. | 52/165 |
| 7,444,787 | B2 * | 11/2008 | Cutforth | 52/295 |
| 7,627,994 | B1 | 12/2009 | Demirkan | |
| 7,730,675 | B2 * | 6/2010 | Hill | 52/153 |
| 7,980,034 | B2 * | 7/2011 | Fehr et al. | 52/297 |
| 8,074,422 | B2 * | 12/2011 | O'Neil et al. | 52/700 |
| 2005/0055960 | A1 * | 3/2005 | O'Neil et al. | 52/698 |
| 2006/0037625 | A1 * | 2/2006 | Kayser et al. | 132/224 |
| 2006/0236647 | A1 | 10/2006 | Fehr et al. | |

* cited by examiner

EASILY CONNECTABLE ANCHOR AND PILLBLOCK REPLACEMENT FOR AN EMBEDDED WOODEN POST

CROSS-REFERENCE TO RELATED APPLICATIONS

This application claims the benefit of priority of U.S. Provisional Application 61/437,801, filed Jan. 31, 2011.

BACKGROUND OF THE INVENTION

This invention relates generally to wooden posts anchored in the earth, and more particularly to an easily-connectable anchor and spacer device for use with wooden posts to be embedded in concrete or similar material.

Embedded wooden posts are used in a variety of building constructions for which the post must not only support the downward loads imposed by the weight building structure, but resist uplift forces, typically the result of wind loads on the building. Such posts are typically anchored in the ground by placement in a post hole which is backfilled with concrete.

A solid footing beneath the post end is necessary to support the weight (downward force) applied to the post. This solid footing is typically provided in one of two ways. The first is a two-step concrete pouring process in which a foundation is first poured in the bottom of the post hole and allowed to cure. A second pour is made to backfill the post once the post is positioned. A second method commonly employed is the use of a "pill block." Pill blocks are pre-formed concrete disks of a pre-determined thickness that are placed into the foundation hole prior to inserting the post in order to provide a foundation to support the base of the post. The post is then positioned atop the pill block; the remainder of the post hole may then be backfilled with concrete to complete the post anchorage.

Uplift capabilities for embedded posts are typically addressed by externally protruding anchors fastened to the post by bolts and the like, or by drilling a transverse hole through the post and inserting a length of rebar that will protrude from the side faces of the post. The external anchor members, once embedded in the concrete backfill provide resistance to post uplift.

The use of two-step backfill processes, pill blocks, bolt-on anchors, and/or through-post bores complicates the process of post embedment. The pill blocks are necessarily heavy owing to their function as a foundation member. A two-step backfill pours requires additional time for intermediate concrete curing. Bolting anchors to posts or drilling holes through posts requires additional time which can be significant if the number of posts to be installed is large.

It would be convenient to provide a more easily installed alternative post anchorage that would minimize the negative time impacts of a load-bearing, uplift resisting post compared to a typical embedded post. Additional benefits would be derived from an alternative post anchorage apparatus that could be easily installed using simple hand tools. Still further benefit would be derived from an alternative post anchorage apparatus that could be economically produced to allow a low-cost means for anchoring posts in concrete.

SUMMARY OF THE INVENTION

Accordingly, the present invention, in any of the embodiments described herein, may provide one or more of the following advantages:

It is an object of the present invention to provide an improved method of anchoring a post in the ground that allows a single concrete pour to produce a suitable footing and backfill anchoring for the post. A bottom spacer is connected to an end of the post that is to be embedded. The connection is simplified by providing connector portions of the bottom spacer each having a plurality of teeth configured to be forced into opposing faces of the wooden post, typically using a hammer. The teeth engage the wood and provide sufficient strength to retain the bottom spacer in position while the post is set and the backfill material introduced into the hole. When inserted into the post hole, the spacer positions the end of the post a pre-determined distance above the bottom of the hole. A single pour of concrete backfill material may then flow beneath the end of the wooden post to support and embed the post upon curing.

It is a further object of the present invention to provide an easily-attachable anchor device for a wooden post that enables an embedded post to withstand substantial uplift forces. The anchor device comprises a length of sheet material formed to create a protrusion extending from the surface of the post. The protrusion is formed by bending the sheet material to form a pair of legs intersecting at an apex; each end of the length of sheet material is configured for contact with the exterior surface of the post. The legs extend from the end lengths. The end lengths also include a plurality of teeth configured to be forced into the surface of the wooden post as the end lengths are pressed into contact with the post surface.

It is a still further object of the present invention to provide an easily-attachable anchor device for a wooden post to be embedded in the ground that is durable in construction, inexpensive of manufacture, carefree of maintenance, easily assembled, and simple and effective to use. The present invention is formed from sheet metal, preferably stainless steel that is less than ⅛-inch thick, bent into the desired shape. The bends are simple, single axis bends. Teeth for engaging the surface of the post are also easily stamped into the sheet metal.

These and other objects are achieved in accordance with the present invention by an anchor device having a plurality of teeth protruding from planar surfaces configured for placement adjacent to the post. The teeth may be forced into the wood to secure the anchor in position until the post embedment is completed. The anchor comprises a first portion that protrudes from the surface of the post to engage with backfill, typically concrete, to resist post uplift once the backfill cures. A second portion of the anchor is secured to the side surfaces of the post adjacent to the end of the post that is to be embedded and extends beyond the end of the post. When the anchor is installed and the post inserted into a hole, the second portion of the anchor elevates the end of the post from the bottom of the post hole so that concrete backfill may flow beneath the post to form a suitable post foundation.

BRIEF DESCRIPTION OF THE DRAWINGS

The advantages of this invention will be apparent upon consideration of the following detailed disclosure of the invention, especially when taken in conjunction with the accompanying drawings wherein.

DESCRIPTION OF THE PREFERRED EMBODIMENT(S)

Many of the fastening, connection, processes and other means and components utilized in this invention are widely known and used in the field of the invention described, and their exact nature or type is not necessary for an understanding and use of the invention by a person skilled in the art, and they will not therefore be discussed in significant detail. Also, any reference herein to the terms "up" or "down," or "top" or "bottom" are used as a matter of mere convenience, and are determined by viewing a post as it would normally be installed on generally level ground. Furthermore, the various components shown or described herein for any specific application of this invention can be varied or altered as anticipated by this invention and the practice of a specific application of any element may already be widely known or used in the art by persons skilled in the art and each will likewise not therefore be discussed in significant detail. When referring to the figures, like parts are numbered the same in all of the figures.

Figure 1:
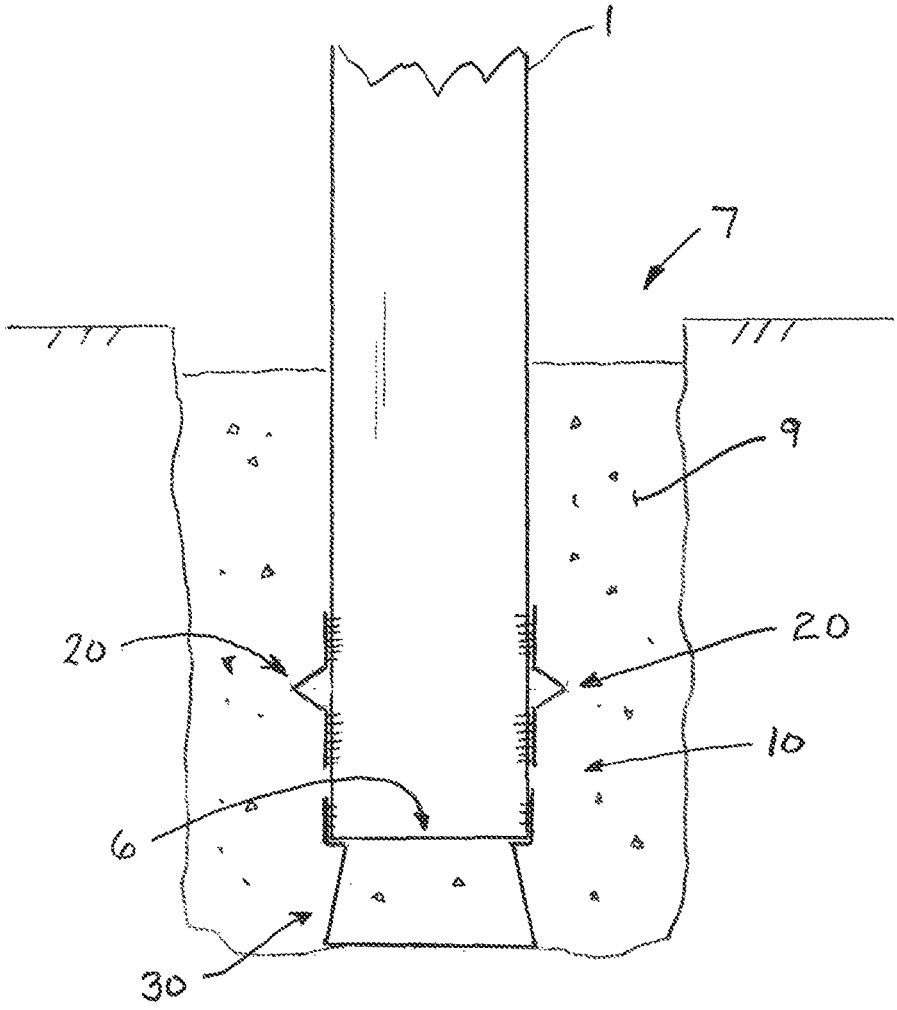
FIG. 1 is a partial side elevation view of a typical wooden post embedded in the ground using a first embodiment of the present invention to provide uplift resistance and foundation support.

FIG. 1 is a side elevation view of a typical wooden post 1 that has been positioned into a post hole 7 in the ground and backfilled with concrete 9. An anchoring device 10 is attached adjacent to the post end 6 which is embedded. The anchor device 10 includes an uplift anchor portion 20 and a foundation portion 30. While uplift anchor portion 20 and foundation portion 30 are shown as a unitary component in FIG. 1, it is not essential that the two portions be integrated. Separating the anchor portion 20 enables the number of anchor portions 20 to be increased beyond the two shown in FIG. 1 to increase uplift resistance, as necessary, for a particular post installation.

Figure 2:
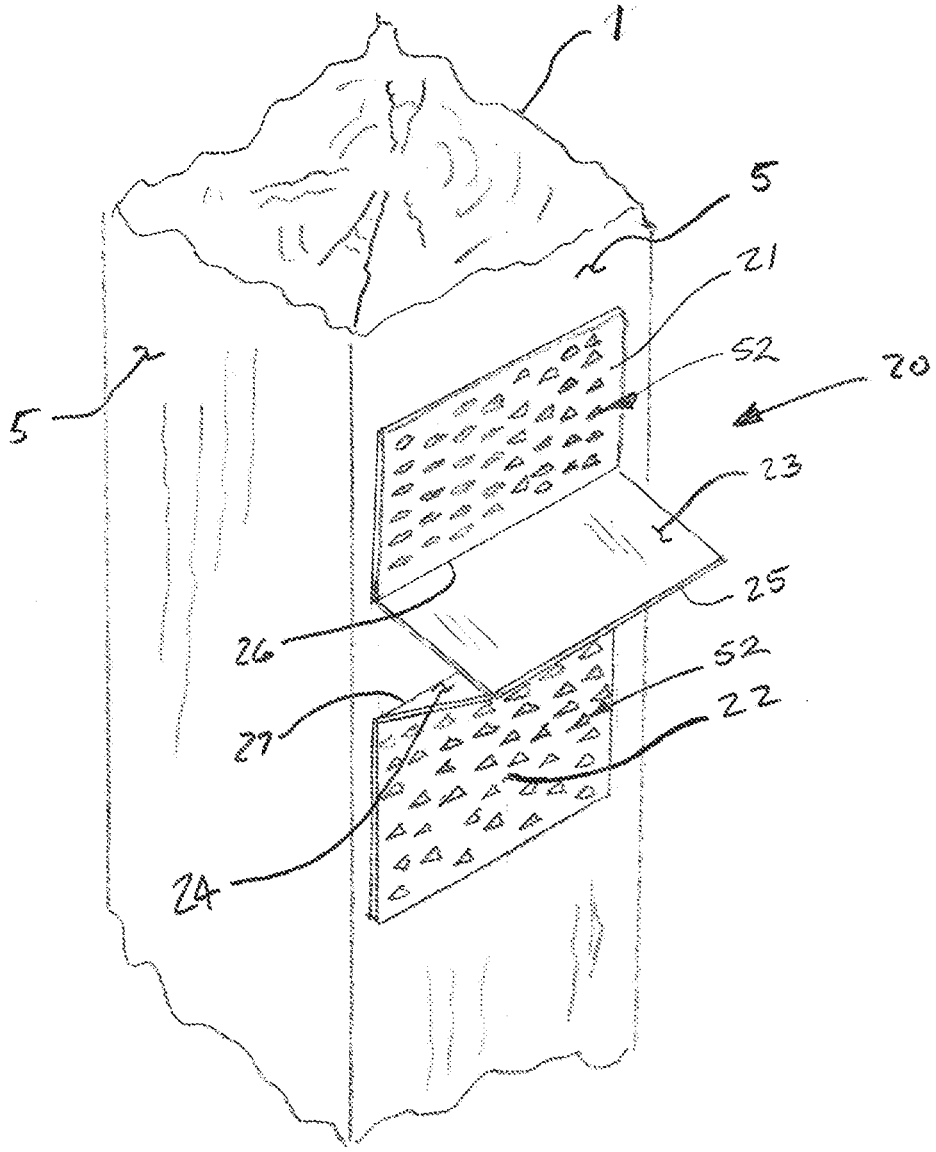
FIG. 2 is a partial perspective view of a second embodiment of the uplift anchor of the present invention.

Referring to FIG. 2, one uplift anchor portion 20 is illustrated attached to a side face 5 of a wooden post 1. The uplift anchor portion 20 comprises first and second attachment portion 21, 22 which are co-planar and intended to be placed adjacent to an exterior face 5 of the post 1. While post 1 is shown as a rectangular cross-section post, the first and second attachment portions may also be contoured for use with circular cross-section posts as well. Extending outwardly from the side face 5 are first and second extensions 23, 24 which intersect at outer bend 25 to form a generally V-shaped retainer structure arranged to interact with the surrounding post backfill to resist axial movement of the post when embedded in the ground. The base edges of the extensions 23, 24 connect to the attachment portions 21, 22 at spaced-apart positions along the axial length of the post thereby forming a generally pyramidal shaped open area bounded by the extensions 23, 24 on two sides and the side face 5 of the post on the third. The outward displacement of outer bend 25 from the exterior face 5 can be varied depending upon specific uplift capacity requirements on the post, but range from as little as one-quarter inch to as much as an inch or more. Testing has demonstrated that an outward displacement of the retainer structure of between one-half and three-quarters of an inch provides an optimal balance of retention capability and retainer structure strength. As the uplift anchor portion 20 is preferably formed from a single strip of sheet material, first and second interior bends 26, 27 are disposed between the attachment portions 21, 22 and extension 23, 24, respectively.

One or more uplift anchor portions 20 may be connected to a post prior to embedment depending upon the uplift force resistance required for the post design. Uplift anchor portions are preferably installed in pair on opposite faces of a rectangular cross-section post (or approximately 180 degrees opposed on circular posts) and at generally the same distance from the post end 6. Vertical spacing between adjacent uplift anchor portions on the same exterior face 5 is determined by the stress cone created by the uplift anchor portion in the backfill material and the strength of the backfill material.

Figure 3:
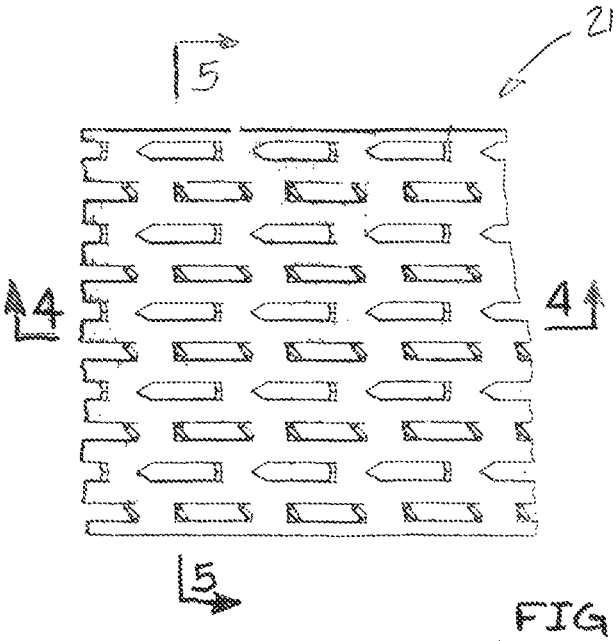
FIGS. 3 through 5 show three views of one type of the teeth that are punched into the sheet metal used to form the present invention thereby creating a means to secure the invention to a wooden post.
Figure 4:
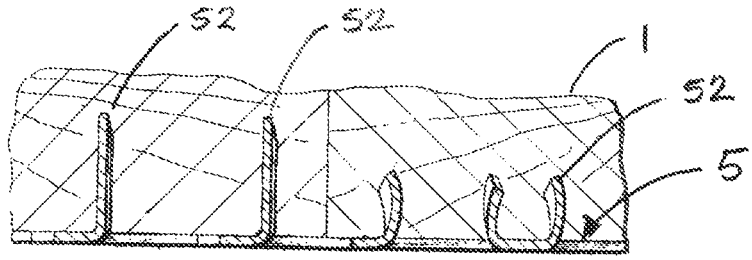
Figure 5:
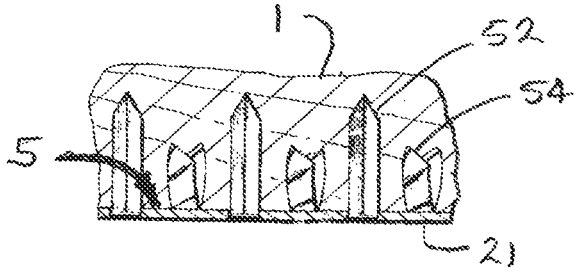

FIGS. 3 through 5 illustrate the plurality of teeth 52 that are stamped into the sheet metal forming the anchoring device 10 and used to secure the anchor device 10 to the post 1 during placement of the post into the post hole 7, and the addition, setting, and curing of a concrete backfill 9 surround the post 1. Specifically referring to FIGS. 3 through 5 in conjunction with FIG. 2, first and second attachment portions 21, 22 each are provided with a plurality of teeth 52 which are punched into the sheet metal of the attachment portions and bent to extend generally perpendicularly toward the wooden post, in the opposite direction from the first and second extensions 23, 24. Typical density of the teeth is on the order eight teeth per square inch of material which allows sufficient undisturbed wood between the teeth to resist pullout and shear forces. Lesser tooth densities are possible, but densities greater than ten per square inch tend to adversely degrade the integrity of the wood. The teeth 52 extend sufficiently into the post 1 to secure the anchor device 10. Teeth extensions between one-quarter inch to three-quarters inch are common with approximately ⅜ to 9/16-inch length being preferred to provide the necessary strength without penetrating the post 1 beyond the depth to which typical pressure treatment would extend. By maintaining the tooth 52 penetration within the typical zone of pressure treatment, the anchor device 10 will not adversely affect the environmental resistance of the post. The attachment portions are easily attachable to a wooden post by positioning the plate adjacent to an exterior surface of the post and driving the teeth into the wood using a hammer or the like. No additional fasteners are necessary and the teeth 52 are properly positioned for driving into the wood by their design (perpendicular to the sheet metal). Teeth 52 are provided on both the first attachment portion 21 and the second attachment portion 22 so that flexure of the bends 25, 26, 27 is minimized once the uplift anchor 20 is attached to the post. Disengagement of the teeth 52 is prevented by the cured concrete backfill in which the post 1 is embedded. The first and second extensions 23, 24 extend outward laterally from the post surface 5 and engage the concrete backfill in a way to resist movement of the post along its longitudinal axis.

Sheet metal plates having a plurality of nail-like teeth 52 with a variety of tooth configurations are well-known in wood frame construction. In flat form, such plates provide a convenient means for connecting wood at joints. A representative example is provided in U.S. Pat. No. 3,892,160 issued to Jureir, et al., on Jul. 1, 1975, the entirety of which is incorporated herein by reference.

The sheet material from which the anchor device is formed may be any material possessing the required strength to support the post during installation and resist the uplift forces imposed. Metallic sheet is preferred for its low cost and ease of punching and bending, an especially consideration in the punching operation for the teeth 52. Since the anchor device is to be embedded in the earth, high corrosion resistance is required, especially for the uplift anchor portion 20. While galvanized steel is suitable, stainless steel is preferred as its corrosion resistance is less likely to be damaged by hammer impacts as the anchor device 10 is being installed on the post.

Metallic sheet material for the anchor device 10, including the uplift anchor portion 20 and foundation anchor portion 30, should be less than ⅛-inch (0.125 inch) thick to allow for easy forming, but sufficiently thick to provide the necessary structural strength. Light gauge sheet material on the order of 16 gauge to 20 gauge (0.0598 to 0.0359 inches) has been found to provide an acceptable balance of strength and formability.

Uplift testing was performed on one embodiment being formed from a 3 inch wide by 7 inch long MiTek® Model M18SHS truss plate fabricated from ASTM A 653 18 gage plate having eight ⅜-inch long teeth per square inch at the first and second attachment portions 21, 22 (approximately 15 square inches total) and a three and one-half inch center section from which first and second extensions 23, 24 are formed to project approximately one-half to three-quarters of an inch from the face of the post. Two anchors were attached to opposite sides of a 6-inch by 6-inch nominal post. The post and anchors were placed in a post hole and encased with three cubic feet of 3,000 psi concrete. Testing under these conditions indicated ultimate tensile load of approximately 30,000 pounds of force before uplift slippage occurred. The testing results were used to establish design limitations. Using a factor of safety of 3 provides a design uplift rating of 10,000 pounds. This result provides much greater uplift capacity than alternative known post anchoring methods. The addition of two 2×6 wooden blocks (one per side) to the post base prior to embedding using six 20d nails per block yields a design uplift rating of approximately 2,000 pounds. Boring a one-half inch hole through the post end displaced at least a post diameter away from the post end and inserting a one-half in diameter rebar that projects from both sides of the post and then embedding in concrete produces a design uplift rating of approximately 2,900 pounds. It is easy to see that the present invention provides not only greater ease of installing the anchor, but dramatically improved uplift capability over conventional alternatives as well.

Figure 6:
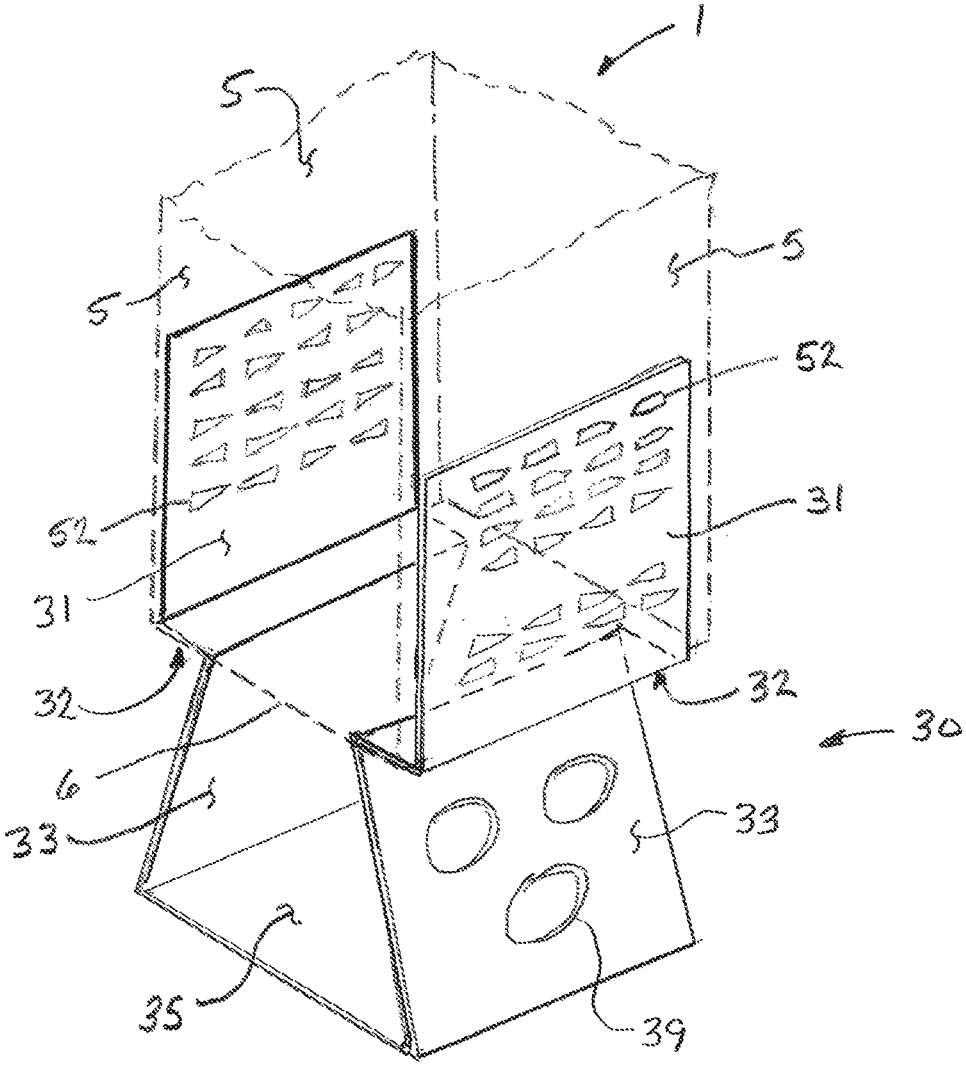
FIG. 6 shows a partial perspective view of a second embodiment of foundation anchor of the present invention.

Finally referring to FIG. 6, a second embodiment of foundation anchor portion 30 of the present invention is shown comprising a pair of generally opposing connector extensions 31, a pair of base supports 32, a pair of support legs 33 and a foot 35 connecting the legs 33. The foundation anchor portion is preferably formed by bending a single strip of sheet metal material into the general shape illustrated in FIG. 6. Connector extensions 31 include a plurality of generally perpendicularly projecting teeth 52, similar to those provided on attachment portions 21, 22 of the uplift anchor portion previously described. The base supports 32 extend along the end 6 of the post to vertically support the post to prevent excessive shear loading on the teeth 52. Support legs 33 extend downwardly from the post end 6 and each join with foot 35. Foot 35 rests on the bottom of the post hole 7 when the post is inserted and maintains a predetermined space between the bottom of the post hole and the end 6 of the post. Concrete backfill material introduced into the hole is then allowed to flow beneath the end 6 of the post as the post hole is backfilled to form a strong vertical foundation for the post 1. The backfill material preferably flows through the generally open portion of the foundation anchor portion (see FIG. 1). Penetrations 39 may also be formed in the support portions to provide alternate paths for backfill material to enter the space beneath the post end 6.

Naturally, the invention is not limited to the foregoing embodiments, but it can also be modified in many ways without departing from the basic concepts. Changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

I claim:

1. An anchor for embedding an end of an upstanding elongate wooden post in the ground, said anchor comprising:

an upper connector plate having a first plurality of teeth extending unidirectionally and generally perpendicularly therefrom, said first plurality of teeth embedded into the post to affix said upper connector thereto;

a lower connector plate having a second plurality of teeth extending unidirectionally and generally perpendicularly therefrom, said second plurality of teeth embedded into the post to affix said lower connector thereto, said lower connector being longitudinally spaced apart from and co-planar with said upper connector; and a generally V-shaped retainer connected to said upper and said lower connector plates, said retainer having first and second planar leg portions outwardly extending from said upper and said lower connector plates, respectively, said first and said second planar leg portions intersecting at an apex edge spaced apart from the post; and a second said anchor connected to the post opposite from first said anchor and a foundation support interconnecting said first and second anchors and positioned adjacent to the post end, said foundation support having a pair of generally planar legs fixedly connected to the exterior surface of the post adjacent to the post end and extending below the post end, said pair of legs interconnected by a foot spaced-apart from and generally parallel to the post end.

2. The anchor of claim 1, wherein each tooth of said first and said second pluralities of teeth is punched and folded from respective said upper and said lower connector plates.

3. The anchor of claim 2, wherein teeth in said first and said second pluralities of teeth range in length from one-quarter to three-quarters of an inch.

4. The anchor of claim 3, wherein said first and said second pluralities of teeth each have a density of up to ten teeth per square inch.

5. The anchor of claim 4, wherein said first and said second pluralities of teeth cover at least ten square inches combined on said upper and said loser connector plates.

6. The anchor of claim 1, wherein said apex edge is spaced apart from the post by an extension of at least one quarter inch.

7. The anchor of claim 6, wherein said extension ranges from one quarter inch to one inch.

8. The anchor of claim 1, wherein said upper and lower connector plates and said retainer have a thickness ranging between 0.03 inches to 0.06 inches.

9. A method of increasing the uplift resistance of an upstanding elongate wooden post partially embedded in the ground with an anchor comprising the steps of:

providing an elongate wooden post having an embedment end and an exterior surface;

providing a plate having a length and a width from which to from the anchor;

folding the plate in a first direction to create an apex edge thereby dividing the length into a first length portion and a second portion;

folding the first portion along a first axis parallel to the apex edge and in a direction opposite to the first direction there dividing the first portion into a first connector portion and a first retainer portion;

folding the second portion along a second axis parallel to the apex edge and in a direction opposite to the first direction in a manner dividing the second portion into a second connector portion and a second retainer portion such that the first retainer portion and the second retainer portion are coplanar;

punching a first plurality of teeth in the first connector portion and unidirectionally bending the first plurality of teeth perpendicular to the connector portion in a direction opposite from the first retainer portion;

punching a second plurality of teeth in the second connector portion and unidirectionally bending the second plurality of teeth perpendicular to the connector portion in the same direction as the first plurality of teeth;

positioning the anchor on the exterior surface of the post adjacent to embedment end;

embedding the first and second pluralities of teeth into the post to affix the anchor to the post;

inserting the post and attached anchor into a hole in the ground; and adding backfill material into the hole so that the first and second retainer portions interact with the backfill material to inhibit axial movement of the post.

10. The method of claim 9, further comprising the step of providing a second anchor for attachment to the post.

* * * * *